United States Patent [19]

Rathbun

[11] Patent Number: 4,555,042

[45] Date of Patent: Nov. 26, 1985

[54] TAMPER RESISTANT CONTAINER AND CLOSURE ASSEMBLY

[76] Inventor: Willard J. Rathbun, 3721 Gary Dr., Castalia, Ohio 44824

[21] Appl. No.: 695,711

[22] Filed: Jan. 28, 1985

[51] Int. Cl.[4] ..... B65D 17/42

[52] U.S. Cl. ..... 220/277; 220/306

[58] Field of Search ..... 220/277, 284, 306, 307; 215/215

[56] References Cited

U.S. PATENT DOCUMENTS

| | | | |
|---|---|---|---|
| 228,031 | 5/1880 | Broughton . | |
| 2,327,411 | 8/1943 | Fink . | |
| 3,672,528 | 6/1972 | Faulstich . | |
| 3,716,162 | 2/1973 | Botkin . | |
| 3,817,420 | 6/1974 | Heisler . | |
| 3,840,152 | 10/1974 | Hodge . | |
| 3,841,512 | 10/1974 | Botkin . | |
| 3,858,748 | 1/1975 | Marco . | |
| 4,024,976 | 5/1977 | Acton . | |
| 4,027,775 | 6/1977 | Mygatt, Jr. et al. . | |
| 4,103,803 | 8/1978 | Irvine . | |
| 4,111,329 | 9/1978 | Lampman . | |
| 4,190,175 | 2/1980 | Allen . | |
| 4,335,827 | 6/1982 | Knize et al. | 220/284 |
| 4,385,711 | 5/1983 | Bowen | 220/284 |
| 4,422,559 | 12/1983 | Landis . | |

*Primary Examiner*—George T. Hall

*Attorney, Agent, or Firm*—Emch, Schaffer, Schaub & Porcello Co.

[57] ABSTRACT

A tamper resistant container and closure assembly is disclosed. The assembly has an annular protective band which shields the lid from unauthorized access prior to removal of the protective band. The protective band is designed such that it resists manual removal and must be mechanically removed by a can opener or other type of cutting tool. Removal of the protective band allows removal of the lid from the container.

4 Claims, 6 Drawing Figures

TAMPER RESISTANT CONTAINER AND CLOSURE ASSEMBLY

BACKGROUND OF THE INVENTION

The present invention relates to a tamper resistant container and closure assembly for general purpose containment of goods. In recent years there has been a proliferation of tamper resistant containers and lids especially in the consumer products area. This has been primarily in response to increased safety concerns and problems with pilfering and contamination of the container contents.

With most of the tamper resistant containers, removal of the protective seal is done manually, usually by breaking or tearing away some portion of the container to allow access to the container lid. Thus containers equipped with such protective seals are easily invaded by unauthorized personnel from the time of production to the time of ultimate sale to the end user.

Another problem with many of the current tamper resistant container design is that some sort of manual manipulation of the container and lid assembly is necessary before the container can be opened. This often requires a fair degree of manual dexterity thus posing a particular problem to older persons and people with arthritus.

It is therefore an object of the present invention to provide a tamper resistant container and closure assembly with a protective seal that is not removable manually but must instead be removed with a cutting tool to reduce the incidence of tampering.

It is a further object of the present invention to provide a tamper resistant container and closure assembly that is easily opened and closed once the protective portion of the container and closure assembly has been mechanically removed.

Other objects and advantages will become apparent from a further review of the following specification, drawings and claims.

DESCRIPTION OF THE PREFERRED EMBODIMENT

Figure 1:
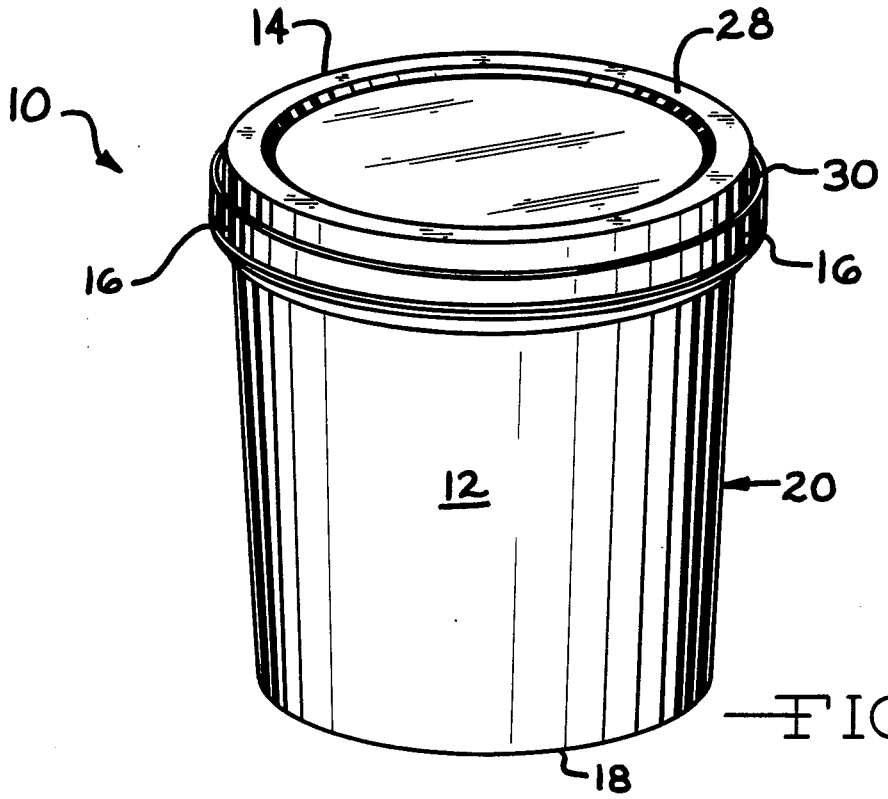
FIG. 1 is a perspective view of a tamper resistant container and closure assembly according to the present invention.
Figure 2:
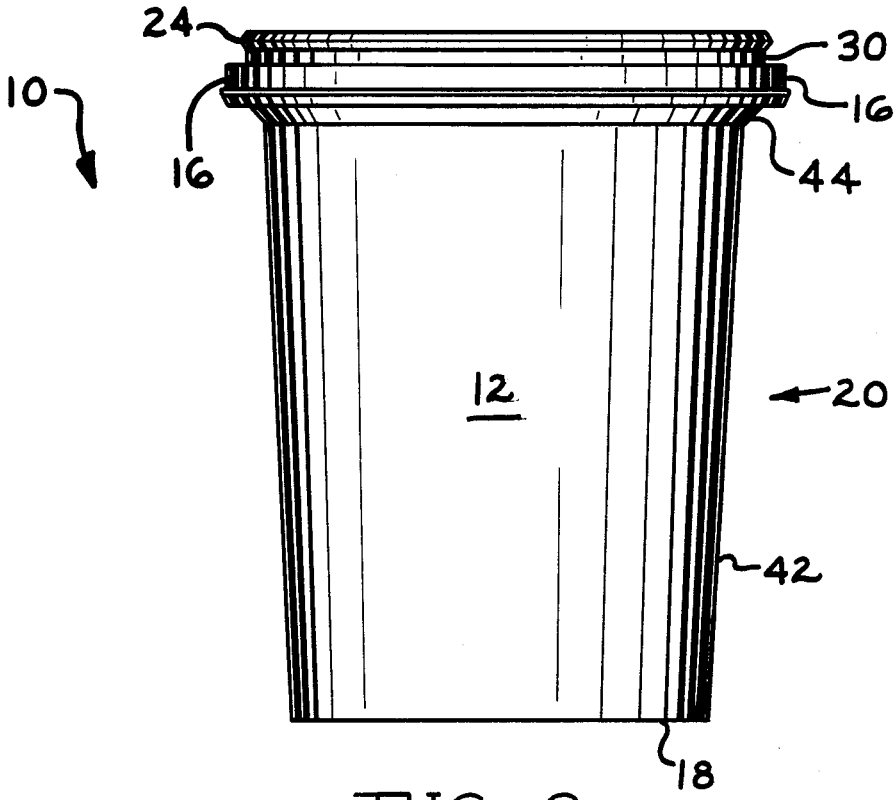
FIG. 2 is a side elevational view of a tamper resistant container according to the present invention.

Referring to FIGS. 1 and 2, there is shown a tamper resistant container and closure assembly 10. The assembly 10 consists of a container 12, a lid 14 and a tamper resistant annular protective band 16 detachably connected to the container 12 and adapted to discourage unauthorized access to or contamination of the contents of the container and closure assembly 10.

Figure 3:
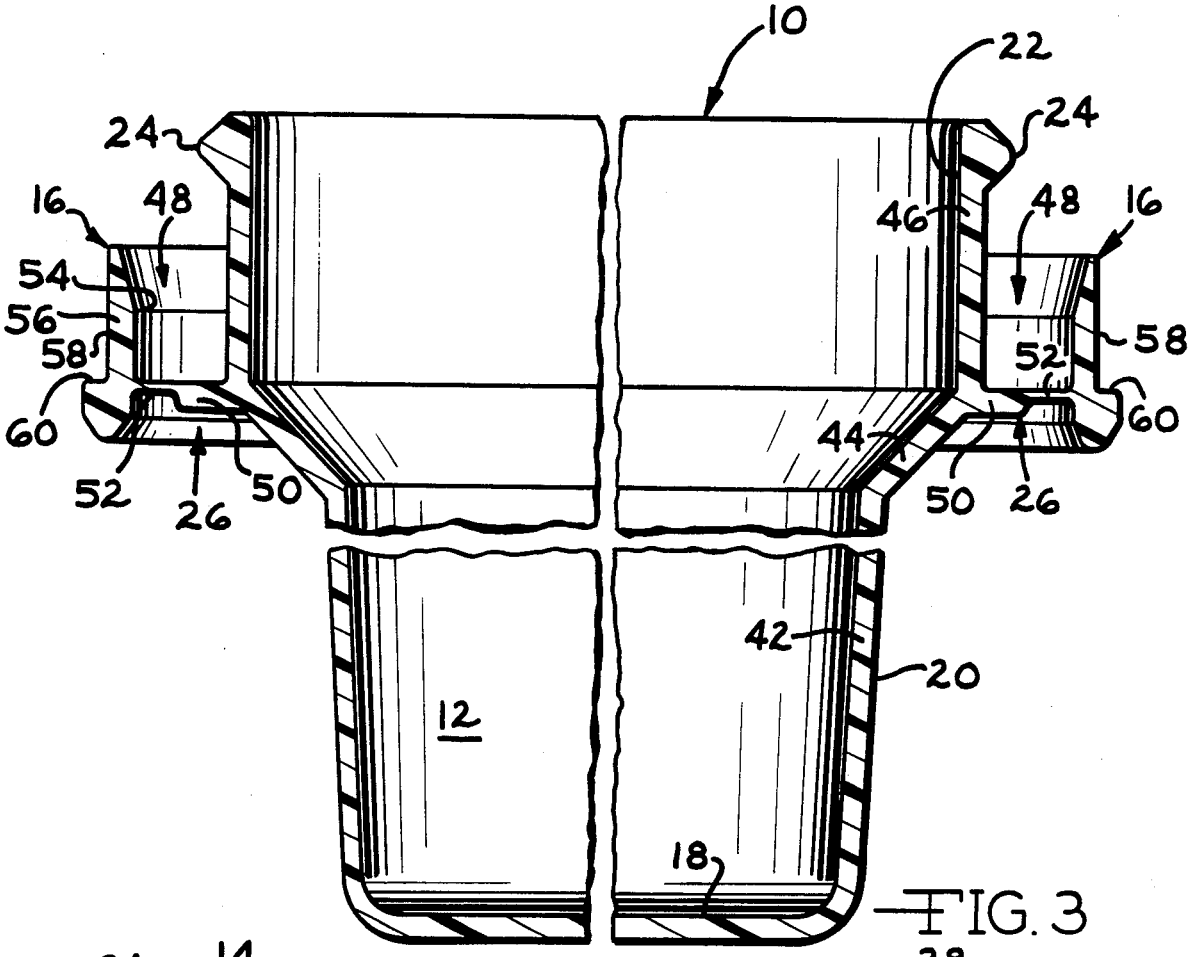
FIG. 3 is a cross-sectional side view of the tamper resistant container according to the present invention.

Referring to FIG. 3, the container 12 has a base 18 and a sidewall 20 which terminates in an open end 22. An annular rim 24 extends about the exterior of the open end 22. The annular protective band 16 is connected to the sidewall 20 by a continuous annular transverse projection 26 as will be explained in further detail below.

Figure 4:
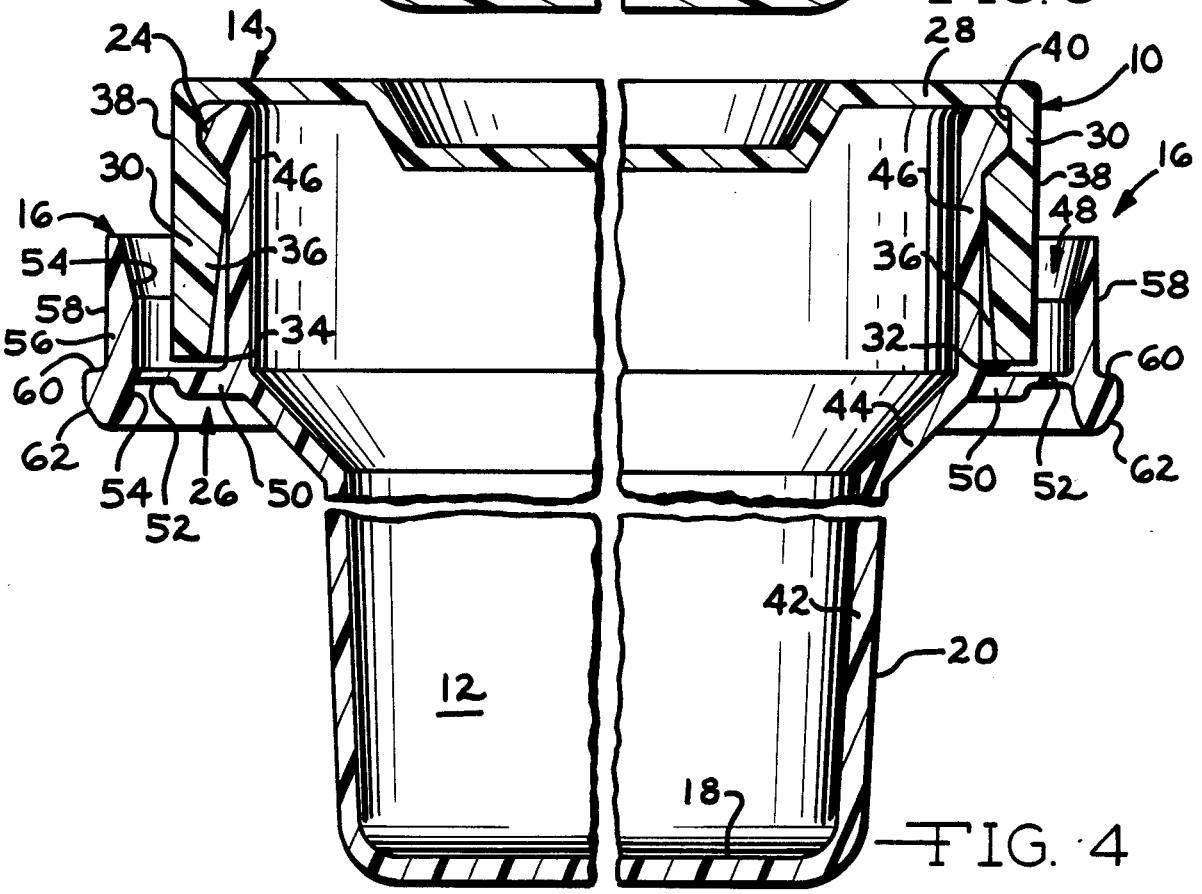
FIG. 4 is a cross-sectional side view of a tamper resistant container and closure assembly according to the present invention.

Referring to FIG. 4, the lid 14 consists of a top 28 and an annular lip 30 which depends from the top 28 and terminates in a bottom edge 32. The bottom edge 32 extends to a level just above the continuous annular transverse projection 26 thereby providing a continuous annular slot 34 for insertion of a hand or tool to remove the lid 14 from the container 12 once the protective band 16 has been mechanically detached from the container 12.

The lip 30 of the lid 14 has an interior surface 36 and an exterior surface 38. Adjacent the top 28 and extending about the interior surface 36 of the lip 30 is an annular recess 40 adapted to receive and engage the rim 24 of the container 12. Together, the rim 24 and annular recess 40 act to maintain the lid 14 in a removably secure relationship with the container 12.

The container sidewall 20, of the present embodiments, has three sections, 42, 44 and 46. The first section 42 is substantially uniform in diameter and comprises the bulk of the sidewall 20 construction as can be best seen in FIG. 2. The second section 44 and third section 46 form the area closest to the top of the container 12 with the third section 46 having a uniform diameter that is larger than the diameter of the first section 42. The second section 44 is disposed between the first and third sections, 42 and 46, and has a uniformly increasing diameter which is equal to the diameter of the first section 42 at its point of contact with the first section 42 and increases to the diameter of the third section 46 at its point of contact with the third section 46.

Extending horizontally from the sidewall 20 at the juncture of the second and third sections 44 and 46 is the continuous annular transverse projection 26 which connects the protective band 16 to the container 12. Together, the protective band 16, transverse projection 26 and third section 46 of sidewall 20 form a channel 48 about the exterior of the container 12 for receiving and shielding the depending lip 30 and bottom edge 32 of the lid 14.

The transverse projection 26 has a first annular portion 50 and a second annular portion 52. The first portion 50 has a thickness greater than the thickness of the second portion 52 (See FIG. 3). The first portion 50 is adjacent the container 12 and extends outwardly from the container 12 a distance approximately equal to the thickness of the lip 30 of the lid 14 at its bottom edge 32 (See FIG. 4). The second portion 52 joins the protective band 16 to the container 12 and has a thickness that cannot be torn manually. For example, if the first portion 50 has a thickness of 0.034 inch, the second portion 52 has a minimum thickness of 0.012 inch. As a result, a cutting tool 80, such as the can opener shown in FIG. 5, must be used to sever the second annular portion 52 in order to remove the protective band 16 from the container 12. It is important that the second portion 52 be of a thickness that must be severed rather than manually torn.

The annular protective band 16 is positioned about and spaced apart from the third section 46 of sidewall 20. It is designed to retard access to the container 12 by shielding the depending lip 30 and bottom edge 32 of the lid 14. The protective band 16 has an interior surface 54 and an exterior surface 56. The interior surface 54 of the band 16 is joined to the container sidewall 20 via the second portion 52 of the transverse projection 26 such that the upper end of the band 16 extends above the transverse projection 26 and the bottom end of the band 16 extends below the transverse projection 26.

Figure 5:
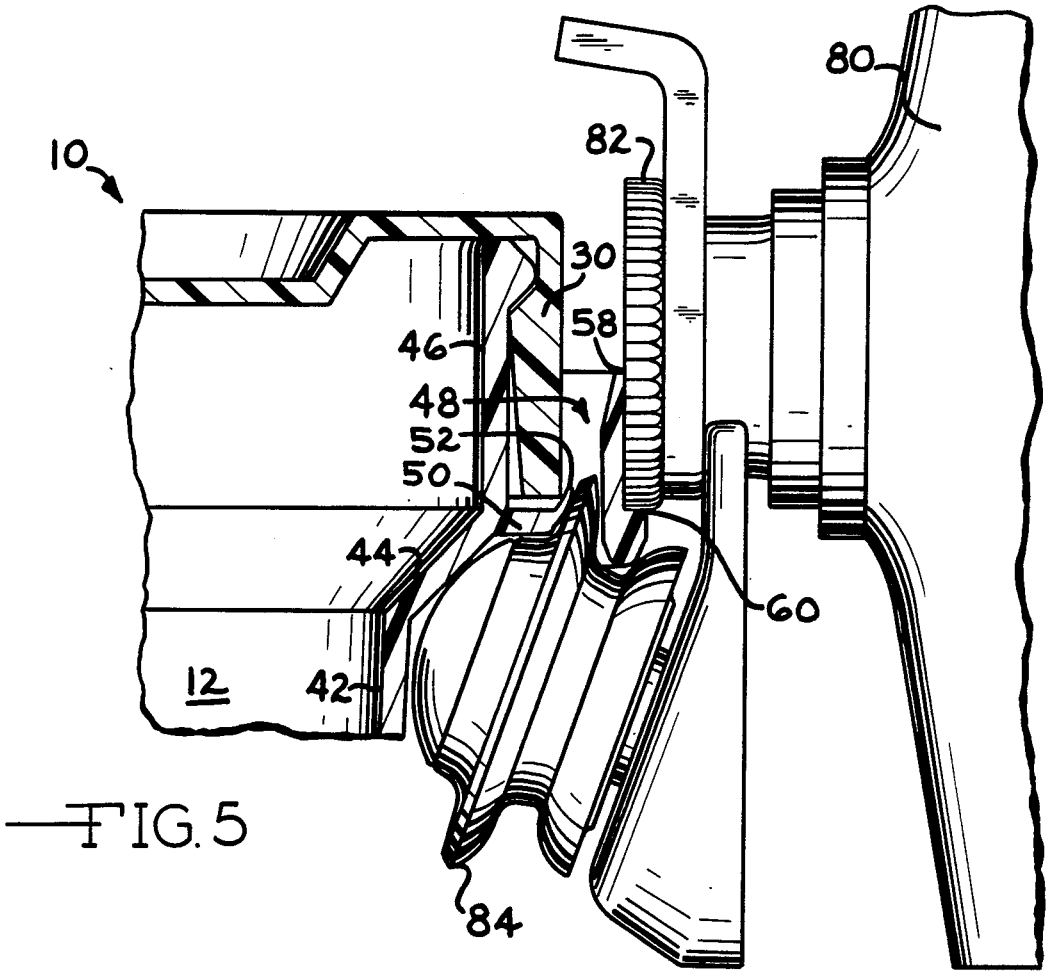
FIG. 5 is a fragmented cross-sectional side view of a can opener engaging and mechanically severing the protective band from the tamper resistant container and closure assembly according to the present invention.

The exterior surface 56 of the continuous annular protective band 16 has a first leg 58, second leg 60 and third leg 62. The first leg 58 of protective band 16 is parallel to the third section 46 of the container sidewall 20 and is approximately one-half the height of the third section 46. The second leg 60 of the protective band 16 is perpendicular to the first leg 58 and extending in a direction away from the container 12. The third leg 62 depends from the second leg 60 and tapers inwardly to meet the interior surface 54 of protective band 16 below the point at which the band 16 is connected to the transverse projection 26. As can be seen in FIG. 5, the first leg 58 and second leg 60 form a surface for contacting the drive gear 82 of can opener 80. With the protective band 16 in place, the depending lip 30 and bottom edge 32 of the lid 14 are positioned in the channel 48, thereby retarding any unauthorized insertion of a tool or hand underneath the edge 32 of the lip 30 to remove the lid 14 from the container 12 prior to the removal of the protective band 16.

To remove the protective band 16 from the container assembly 10 a cutting tool, such as the can opener 80 shown in FIG. 5, must be used to sever the second portion 52 of transverse projection 26. The second portion 52 of the transverse projection 26 is of a sufficient thickness to prevent a normal tearing by hand.

Referring to FIG. 5, any type of can opener may be used to remove the protective band 16, however access to the second portion 52 is only possible from the underside of the container 12. This is because the channel 48 is to narrow and deep to allow insertion of the can opener cutting blade 84 from the top. As a result, the container assembly 10 should be inverted prior to placing it on the can opener 80 to facilitate detachment of the protective band 16. (In FIG. 5 the container assembly 10 is shown in the upright position).

Figure 6:
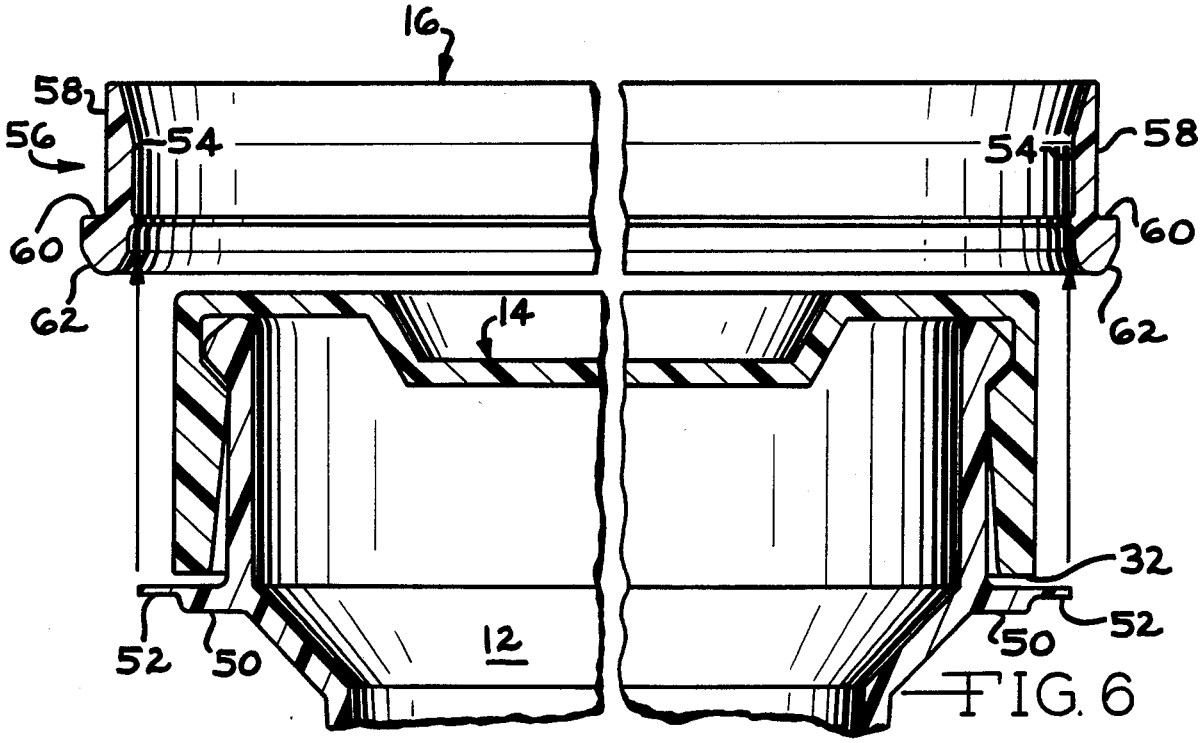
FIG. 6 is a fragmented cross-sectional side view of the severed protective band being removed from the tamper resistant container and closure assembly thereby allowing removal of the lid from the container according to the present invention.

As the container assembly 10 and can opener 80 are engaged with one another, the cutting blade 84 pierces the second portion 52 of the transverse projection 26 and the can opener drive gear 82 engages the first and second legs 58 and 60 of protective band 16. The can opener drive gear 82 is then activated and the entire second portion 52 of the continuous annular transverse projection 26 is cut thus severing the protective band 16 from the container 12. Referring to FIG. 6, once the protective band 16 has been severed from the container 12, it is removed thus allowing access to the depending lip 30 of the lid 14 for opening and closing the container 12.

The entire container assembly 10 is designed so that it can be made easily by injection molding. The material used for molding the container and closure assembly 10 is plastic, such as polystyrene or polyethylene. Once the container has been filled and the lid closed, access to the contents is difficult without the aid of a can opener or other cutting tool such as a knife, etc., to remove the protective band As a result, tampering is far less likely since the protective band is not removable by simple manual manipulation. This in turn means that the package is more likely to be transferred from the production line to the end user intact and unharmed.

After initial opening by severing the projection 26, the lid 14 is retained on the container 12 by a friction fit between the annular rim 24 defined on the container 12 and the complimentary recess 40 defined by the lid 14.

Having thus described the invention in detail it should be understood that various modifications and changes can be made in the invention without departing from the scope and spirit of the following claims.

What I claim is:

1. A tamper resistant container and closure assembly comprising a container, a lid and a tamper resistant protective band, said container having a base and a sidewall which terminates in an open end, said annular protective band being positioned about and spaced apart from said container sidewall near said open end, said annular protective band being attached to said container sidewall by a continuous annular transverse projection extending horizontally from the exterior of said container sidewall, said continuous annular transverse projection being of a non-tearable thickness, whereby such transverse projection must be severed with a cutting tool to detach said protective band from said container; said lid having a top and an annular lip depending from said top, said lip having an interior surface, an exterior surface and a bottom edge, said container sidewall, said continuous annular transverse projection and said annular protective band forming a channel about the exterior of said container adapted to receive said bottom edge of said depending lip of said lid thereby preventing unauthorized removal of said lid prior to removal of said annular protective band, whereby removal of said annular protective band is accomplished by using a cutting tool to sever said continuous annular transverse projection thereby causing said annular protective band to be separated from said container and exposing said bottom edge of said depending annular lip of said lid.

2. A tamper resistant container and closure assembly comprising a container, a lid and a tamper resistant protective band, said container having a base and a sidewall which terminates in an open end, said sidewall defining an annular rim extending about the exterior of said open end; said annular protective band being positioned about and spaced apart from said container sidewall near said open end, said annular protective band being attached to said container sidewall by a continuous annular transverse projection extending horizontally from the exterior of said container sidewall, said continuous annular transverse projection having a first portion and a second portion, said first portion being adjacent said container and having a thickness greater than said second portion, said second portion being of a non-manually tearable thickness, whereby such second portion must be severed with a cutting tool to detach said protective band from said container; said lid having a top and an annular lip depending from said top, said lip having an interior surface, an exterior surface and a bottom edge, said interior surface of said lip defining an annular recess adjacent said top of said lid adapted to receive said rim of said container and maintain said lid in a removably secure relationship with said container; said container sidewall, said continuous annular transverse projection and said annular protective band forming a channel about the exterior of said container adapted to receive said bottom edge of said depending lip of said lid thereby preventing unauthorized removal of said lid prior to removal of said annular protective band, whereby removal of said annular protective band is accomplished by using a cutting tool to sever said second portion of said continuous annular transverse projection thereby causing said annular protective band to be separated from said container and exposing said bottom edge of said depending annular lip of said lid.

3. In a tamper resistant container and closure assembly according to claim 2, wherein said sidewall has a first section of substantially uniform diameter, a second section, and a third section of uniform diameter which is larger than the diameter of said first section, said second section being disposed between said first and third sections, said second section having a vertically increasing diameter which is equal to the diameter of said first section at its point of contact with said first section and which is equal to the diameter of said third section at its point of contact with said third section.

4. A tamper resistant container and closure assembly comprising a container, a lid and a tamper resistant annular protective band detachably connected to said container by a continuous annular transverse projection; said container having a base and a sidewall which terminates in an open end, said sidewall defining an annular rim extending about its exterior adjacent said open end, said sidewall having a first section of substantially uniform diameter, a second section and a third section of uniform diameter which is larger than the diameter of said first section, said second section being disposed between said first and third sections, said second section having a vertically increasing diameter which is equal to the diameter of said first section at its point of contact with said first section and which is equal to the diameter of said third section at its point of contact with said third section; said continuous annular transverse projection extending horizontally from said sidewall at the juncture of said second section and said third section, said continuous annular transverse projection having a first annular portion and a second annular portion, said first portion being adjacent said container and having a thickness greater than said second portion, said second portion being concentric with and spaced outwardly from said first annular portion, said second annular portion having a non-tearable thickness which resists manual tearing and must be severed with a can opener to detach said annular protective band from said container and expose said lid for removal from said container; said second annular portion having a thickness of at least 0.012 inch, said lid having a top and an annular lip depending from said top, said lip having an interior surface, an exterior surface and a bottom edge, said interior surface of said lip having an annular recess adjacent said top of said lid adapted to receive said rim of said container and maintain said lid in a removably secure relationship with said container, said bottom edge of said lip depending from said top to a level just above said first portion of said continuous annular transverse projection thereby creating an annular slot between said lip bottom edge and said first section for insertion of a thumbnail or tool to assist in removing said lid from said container once said annular protective band has been mechanically removed from said container by the can opener; said protective band being positioned about and spaced apart from said third section of said sidewall, said band having an interior and exterior surface, said interior surface being joined to said second portion of said continuous annular transverse projection such that said protective band extends above and below said continuous annular transverse projection, said exterior surface of said protective band having a first leg which is parallel to said third section of said container sidewall, a second leg which is perpendicular to said first leg and extends outwardly from said container and a third leg which depends from said second leg and tapers inwardly to meet the interior surface of said protective band below the point at which said protective band is connected to said continuous annular transverse projection, said first and second legs forming a surface for contacting a drive gear of a can opener; said annular securement band, said continuous annular transverse projection and said third section of said container sidewall forming a channel about the exterior of said container for receiving said depending lip of said lid, thereby preventing an unauthorized insertion of a tool or hand underneath said lip to remove said lid from said container prior to the removal of said annular securement band by a can opener; whereby removal of said protective band is accomplished by using a can opener to sever said second annular portion of said continuous transverse annular projection thereby causing said annular protective band to be severed from said container and allowing access to the bottom edge of the depending lip of said lid for opening said container.

* * * * *